PFR24 XR 4,680,812

United States Patent [19]

Weigl

[11] Patent Number: 4,680,812

[45] Date of Patent: Jul. 21, 1987

[54] ARMOR FOR PROTECTING BODY REGIONS

[76] Inventor: Adolf Weigl, Tegelweg 129, 2000 Hamburg 72, Fed. Rep. of Germany

[21] Appl. No.: 889,511

[22] Filed: Jul. 25, 1986

[30] Foreign Application Priority Data

Aug. 2, 1985 [DE] Fed. Rep. of Germany ..... 3527691
Sep. 21, 1985 [DE] Fed. Rep. of Germany ..... 3533816

[51] Int. Cl.[4] ..... A41D 13/00; F41H 1/02
[52] U.S. Cl. ..... 2/2; 2/2.5
[58] Field of Search ..... 2/2, 2.5, 22

[56] References Cited

U.S. PATENT DOCUMENTS 2,050,178 8/1936 Hite ..... 2/2.5
3,958,569 5/1976 Vosburgh ..... 2/22

FOREIGN PATENT DOCUMENTS 0719676 4/1942 Fed. Rep. of Germany ..... 2/2
2741180 9/1984 Fed. Rep. of Germany .
8426849 12/1984 Fed. Rep. of Germany .
3401111 7/1985 Fed. Rep. of Germany ..... 2/2
0490913 5/1919 France ..... 2/2.5
0627567 10/1927 France ..... 2/2
1181619 9/1985 U.S.S.R. ..... 2/2

*Primary Examiner*—Louis K. Rimrodt
*Attorney, Agent, or Firm*—Walter C. Farley

[57] ABSTRACT

A plurality of plates are placed in overlapping relationship in an elongated array extending along the spinal column or other body area to be protected. The plates are pivotally interconnected by joints which allow relative rotation to a limited extent between the plates and limited longitudinal movement between the plates so that the armor structure conforms to body changes during normal movements. Overextension is prevented by abutment of the plates against each other, limiting harmful movement of the protected body portions. An arrangement particularly adapted for protecting the spinal column is disclosed.

19 Claims, 9 Drawing Figures

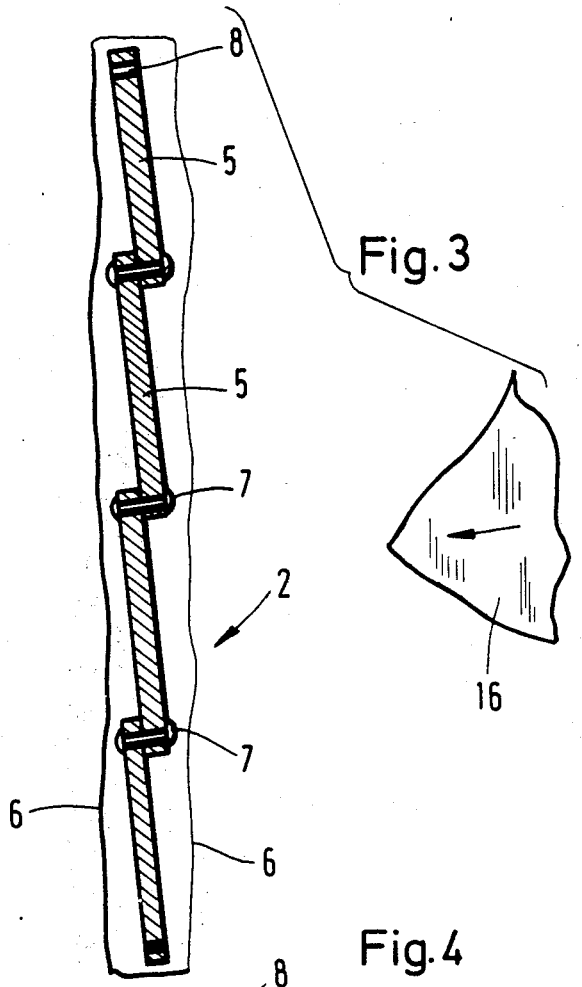
Fig. 3
Fig. 4
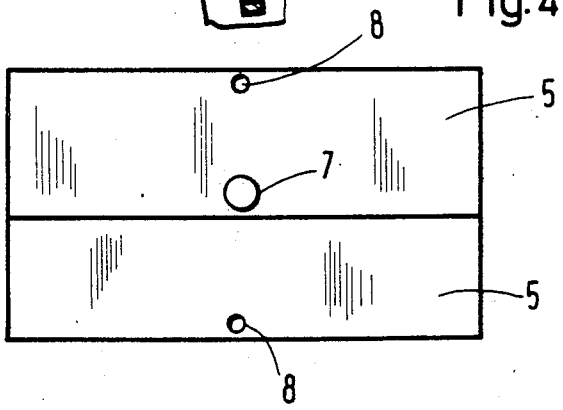

ARMOR FOR PROTECTING BODY REGIONS

This invention relates to body armor of the type which is wearable and which is effective to protect particular regions of the body against impact and other damage, particularly the spinal column.

BACKGROUND OF THE INVENTION

Body armor of the type to which the invention relates is worn adjacent the area of the body to be protected. If that area is the spinal column, the armor is worn on the back, next to the body, and protects it against shocks and impact which could damage the spinal column. This sort of armor is suitable for high-risk occupations and especially for motorcycle drivers who are subject to high accident risk, very often experiencing injuries to the spinal cord in accidents which commonly result in tragic paralysis.

The injuries to the spinal cord resulting from such an accident commonly have one of two causes. One type of injury involves impact by a relatively pointed object which can destroy the spinal cord. The other form of injury involves overextension in a backward direction which can break the spinal column and cord. Thus, to be effective, body armor worn to protect this region must be able to protect against blows by pointed objects and also against overextension of the spinal cord.

A body armor structure of this general type is shown in German Utility Patent No. 84 26 849. That construction provides for a series of adjacent shock resistant plates which spread the effect of point impacts over a broad region so that the spinal cord itself is not subjected to the pointed strike. In order to protect the spinal cord against overextension, the plates are positioned flat against the back in the longitudinal direction of the spinal column and are connected to a flexible fabric which holds the plates together, the fabric being in contact with the body. The plate-fabric configuration can thus be bent to the front, allowing the wearer to bend over during which space forms between the impact plates. However, an effort to bend backwardly to an excessive degree causes the plates to abut each other and, with the fabric, prevent bending in the wrong direction.

However, this design has certain disadvantages. One is that the armor is uncomfortable to wear because the design does not allow for lateral motions of the spinal cord. The motorcycle driver, for example, cannot bend over to the side to view the engine or open the gas tank. Secondly, the protective effect of this design is achieved only under ideal conditions because it presupposes an extremely rigid fabric and a firm connection between the plates and the fabric. Thus, this design is very expensive and can become unreliable if used for a long period of time.

SUMMARY OF THE INVENTION

Accordingly, an object of the present invention is to provide an armor structure for protecting specific regions of the body which has a high degree of wear comfort and a high degree of reliability but is concurrently inexpensive to manufacture.

Briefly described, the invention includes a body armor structure for protecting a designated portion of the body comprising a plurality of plates each having a width greater than the designated portion of the body, and means for interconnecting the plates in a scalelike, elongated array extending generally perpendicular to the width dimensions of the plates, the plates being interconnected in an overlapping relationship such that at least the central portion of one edge of each plate lies outwardly of the adjacent edge of the next plate relative to the designated portion of the body. The means for interconnecting includes hinge means pivotally connecting the central portion of the one edge to the adjacent edge of the next plate such that adjacent plates are relatively pivotable about an axis which is generally perpendicular to the surfaces of the plates.

The arrangement provided in accordance with the invention provides for a single overlap between adjacent plates and a hinge connection at the center. As a result, each plate is firmly connected to the neighboring plate in the longitudinal direction of the spinal column so that any possible hits or shocks are transferred from one plate in both longitudinal directions to the neighboring plates and, therefore, the impacts are distributed to a large area. Protection against overextension is also provided because each plate is maintained at both overlapping points to the neighboring by the hinge connection, given the flat interlock to the neighboring plate, and the plates therefore work against overextension in a manner similar to a continuous plate. Because the plates are connected to each other in the center with a pivotable connection, the spinal column can be bent somewhat to the sides so that wear comfort is increased.

BRIEF DESCRIPTION OF THE DRAWINGS

In order to impart full understanding of the manner in which these and other objectives are attained in accordance with the invention, particularly advantageous embodiments thereof will be described with reference to the accompanying drawings, which form a part of this specification and wherein:

FIG. 3 is a side elevation, in section, along line 3—3 of FIGS. 1 and 2;

FIG. 4 is a rear view of two interconnected plates of the body armor of FIG. 3 apart from the remainder of the structure;

DESCRIPTION OF THE PREFERRED EMBODIMENTS

Figure 1:
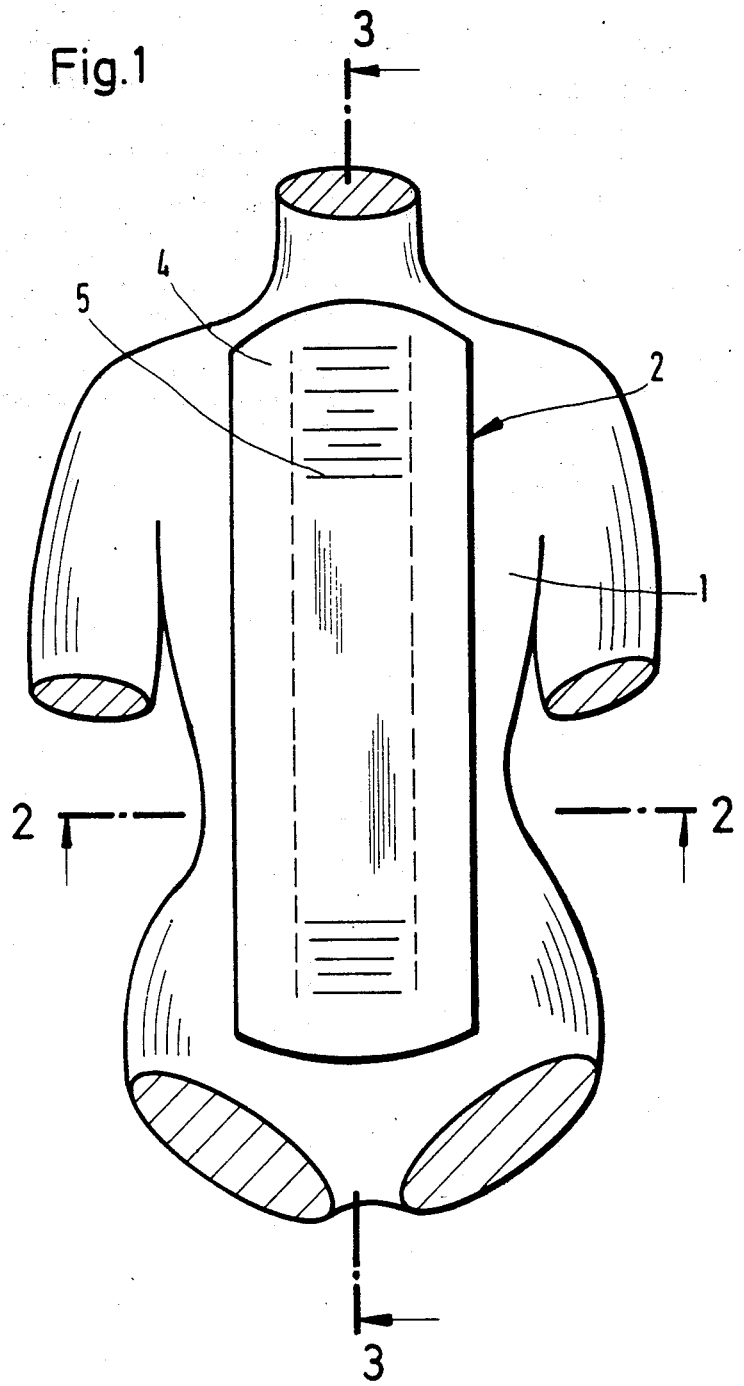
FIG. 1 is a schematic rear elevation of a torso with a body armor structure in accordance with the invention appropriately positioned thereon.
Figure 2:
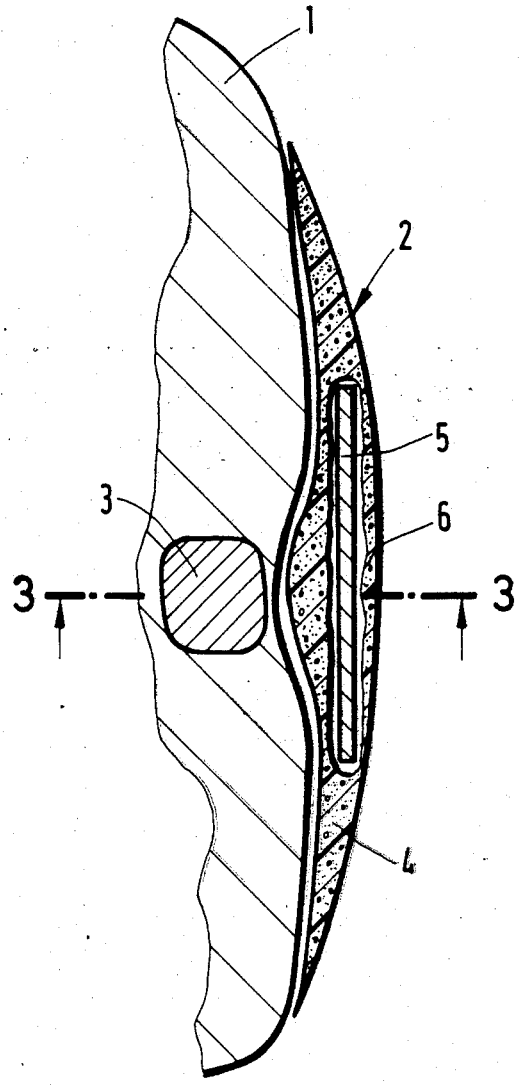
FIG. 2 is a transverse sectional view along line 2—2 of FIG. 1.

Referring first to FIGS. 1 and 2, there is schematically shown the torso 1 of a person, as seen from behind, wearing a body armor structure indicated generally at 2 which extends along the back and covers almost the entire length of the spinal column. The schematic cross-section of FIG. 2 shows the back of the torso 1 and schematically illustrates the position of the spinal column 3 and also shows one of the plates 5 of the armor structure 2. It will be observed that the width W of each plate 5 is sufficiently great to extend beyond both sides of the area of the spine and, preferably, extend across the longitudinal bulges on either side of the spine formed by the flexor muscles bracketing the vertebral column. As seen in FIG. 2, the plates 5 are housed within a casing 6. In the embodiment shown, a layer or body of a casting compound is provided on the exterior of casing 6. This compound can, for example, consist of a foam material and serves the purpose of ensuring greater wear comfort as well as additional protection against impacts. The contour of the layer of foam 4 in contact with the back is shaped to fit the contours of the back and assures good centering of the plates 5 with respect to the spinal column 3.

It is further advantageous to house the entire body armor structure 2 in a jacket such as a motorcycle jacket, sewing the armor structure including the casing and surrounding foam between the lining and the exterior hide of the jacket. This assures that the armor structure can be put on easily and comfortably, eliminating the need for belts or the like which might otherwise be required, so that the armor is worn automatically whenever the jacket is put on.

As shown in the longitudinal section of FIG. 3, a plurality of plates 5 are arranged in a longitudinal array in the longitudinal direction of the spinal column and are placed in a row such that the edges overlap. The plates are relatively short in the longitudinal direction of the array and of the spinal column but have a width which easily extends beyond the sides of the spinal column as previously discussed.

At the points of overlap of two contacting plates as seen in FIGS. 3 and 4, the plates are connected by a hinge which, in the simplified embodiment of FIG. 3, includes holes 8 through the adjacent edges of the plates 5 and pivot pins 7 extending through the holes, the pins having enlarged heads to keep them in position. The hinge structure formed by the holes 8 and pins 7 is centrally located in each of the plates, as illustrated in FIG. 4, so that the pins lie in a line essentially aligned with the spinal column. This permits simple lateral motion of the spinal column in which the armor structure moves concomitantly to the side because of the hinge structure.

The pivot pins 7 each are provided with external rivet heads, as seen in FIG. 3, and hold the connected plates firmly to each other. In the event that the armor is struck by a sharp object schematically illustrated at 16 in FIG. 3, the plates act as a unitary shield and transfer the impact over a large area of the body so that destruction of the spinal column is avoided.

As also seen in FIG. 3, casing 6 assures that the plates can move freely around the hinges with respect to each other and avoids the possibility of engaging parts of clothing, such as a shirt worn by the wearer, between the plates as they pivot.

Further embodiments of armor structure in accordance with the invention are shown in FIGS. 5–9. These figures show structures which are illustrated in somewhat more detail and which have proven to be effective in experimental tests.

Figure 5:
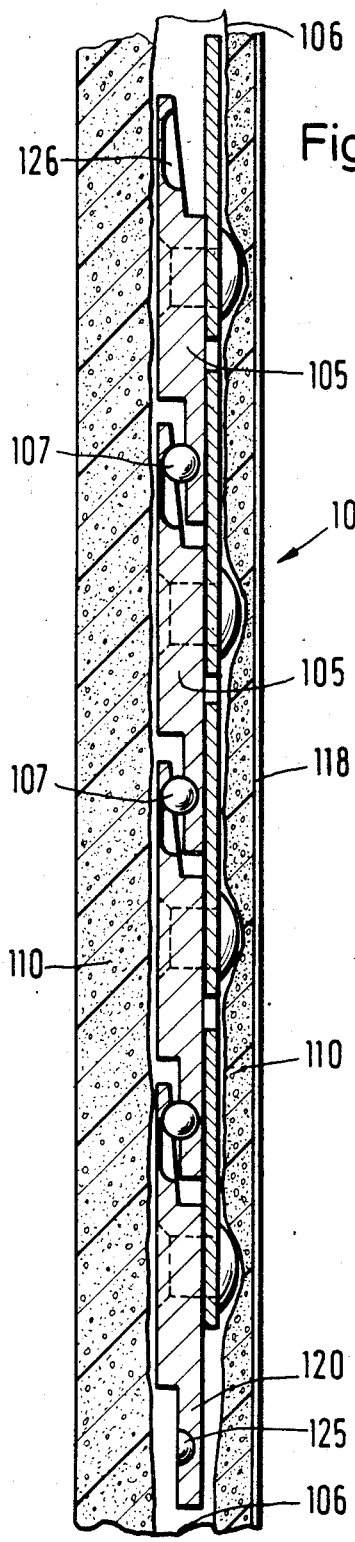
FIG. 5 is a side elevation, in section along the longitudinal center line of a further embodiment of a body armor structure in accordance with the invention, the armor being shown in a straight position.

FIG. 5 shows a structure for protecting the back, the view being a section along the longitudinal center line which is essentially parallel with the spinal column to be protected. The armor structure 102 shown should be worn so that the back of the wearer is to the left as seen in FIG. 5. The illustration is approximately twice the size of the actual article.

Plates 105 are hingedly interconnected in an overlapping relationship by means of joint balls 107 which are disposed centrally with respect to the lateral extent of the plates in a manner which corresponds basically to the embodiment of FIGS. 3 and 4.

As with the previous embodiment, the plate arrangement is surrounded by a hose-shaped sheathing 106 which closely surrounds the plate array. In addition to the sheathing 106 a molded body of foam material 110 surrounds the sheathing, the material being a volumetrically elastic foam which increases the wearing comfort. On the outside of the foam a web 18 is arranged for protecting the foam against wear and also, if desired, providing an ornamental effect.

Sheathing 106 is quite closely adjacent plates 105 and has, first, the primary object of maintaining the plates free from penetration by portions of foam 110 which might be caught between the plates in order to ensure the mobility of the plates relative to each other. If the plate arrangement is used without surrounding foam, which is also possible, the sheathing should be provided in any event to prevent the penetration of dirt or the clamping of skin or a shirt between the plates.

Figure 6:
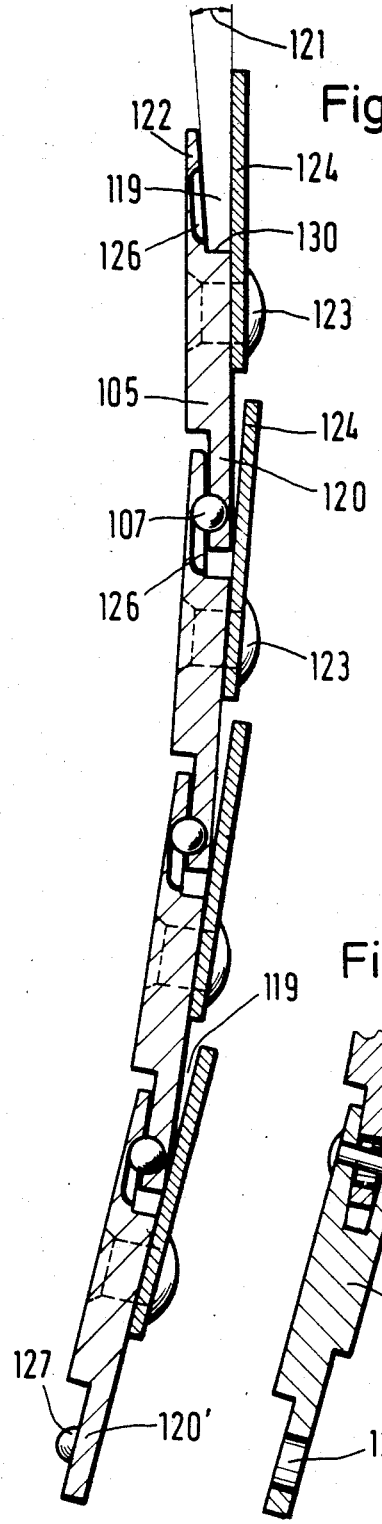
FIG. 6 is a side elevation of a portion of the structure of FIG. 5 showing the body armor in a bent configuration.

The relationship between the plates can be understood more clearly with reference to FIGS. 5 and 6 together. Each plate 105 is formed to have a transversely extending groove 119 at its upper edge and a tongue 120 at its lower edge. The tongues and grooves engage one another in the assembled position as seen in the two figures.

As shown on the upper plate in FIG. 6, the groove 119 has inwardly facing opposite walls which include an aperture angle 121 which is significantly larger than the corresponding aperture angle of the tongue, i.e., the angle between the opposite faces of the tongue which, in the illustrated embodiment, has parallel surfaces between which the aperture angle is zero. There is thus a difference in the aperture angle of the groove and tongue which permits relative tilting of the plates 105 with respect to each other. The two extreme positions of tilting are shown in FIGS. 5 and 6. In FIG. 5, each plate is tilted as far as possible in the clockwise direction with respect to the next lower plate and in FIG. 6 each plate is tilted as far as possible in the counterclockwise direction with respect to the next lower plate. Further tilting is limited in each case by contact of the tongue 120 with portions of the groove in which it is inserted.

The embodiment shown in FIGS. 5 and 6 thus enables the upper body of the wearer to be bent forward to the extent of the illustrated motion which is chosen by selection of the relative aperture angles and which should be sufficient for normal bodily movement. However, overextension in the opposite direction beyond the upright upper body position is prevented. Thus, the structure provides the desired overextension protection to prevent breakage of the spinal column resulting from a severe transverse impact across the back.

As shown in FIGS. 5 and 6, the portions of the plate structure forming groove 119 can be made from two separate members to simplify the manufacture of plates 105. The left-hand groove wall 122 is formed integrally with plate 105. The right-hand groove wall, however, is formed by a steel plate 124 attached to plate 125 by a rivet 123.

The high strength value of plate 124 ensures blockage of excessive bending back of the spinal column and protects, in particular, against impact loads which could lead to breakage of the spinal column. Bending forward of the spinal column is less critical. Thus, the left-hand groove wall 122 can be constructed to be somewhat weaker or can be slightly elastically resilient, if desired, and will be sufficient to limit motion in the forward direction.

The joint connection of the plates with each other shown in the embodiment of FIGS. 3 and 4 permits no longitudinal movement between the plates in the direction of overlap. However, the embodiment of FIGS. 5 and 6 has a joint which permits longitudinal movement of the plates relative to each other.

The plates are connected in an articulated fashion so as to be rotatable with respect to one another in the plane of the plates by means of joint balls 107. The joint balls each sit in a semi-spherical recess 125 formed in the surface of the tongue which faces the back of the wearer. Each ball also engages an elongated recess 126 which is formed in the groove wall 122 integral with plate 125. The elongated recess 126 permits the desired relative longitudinal movement between plates. At the same time, the plates can be pivoted relative to each other as in the previous embodiment.

The joint balls 107 sit fixedly in recesses 125 and are shown in the most elongated position of the plate array in both FIGS. 5 and 6. When the balls are moved to the lower ends of recesses 126, the array being in its shortest position, the plates come into mutual abutment. This occurs in the embodiment shown substantially simultaneously at three points, one being the abutment of the lower ends of tongues 120 with the base 130 of each groove; the second being abutment of the step between tongue 120 and the main portion of the plate 105 with the end of the left-hand groove wall 122; and the third being abutment of the steel plates 124 against each other. Only one abutment is, however, sufficient, such as the tongue with the base of the groove. However, any of the abutment actions can be selected by appropriate dimensioning to limit the degree of shortening of the plate array including simply allowing the ball to reach the end of recess 126.

An alternative to using an independent ball in each joint is illustrated at the bottom plate of FIG. 6 in which tongue 120' is provided with a fixedly attached projection 127 which has a semi-spherical end to be received in the mating recess 126 of the next lower plate.

Figure 7:
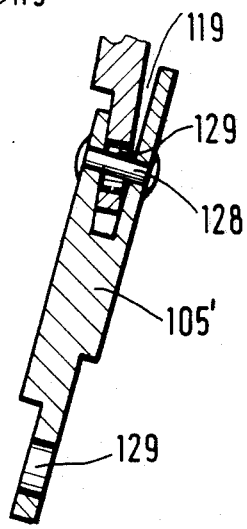
FIG. 7 is a side elevation, in section, of a further embodiment of a hinge structure in accordance with the invention.

A further alternative joint arrangement is shown in FIG. 7 in which each plate 105' has a tongue with a hole 129 extending therethrough. Integrally molded walls forming the groove 119 also are provided with holes through which a pivot pin 128 extends, the ends of the pin having enlarged heads to keep the pin in position. Opening 129 is elongated in the longitudinal direction of the array to permit relative elongation and shortening of the entire array. Rotation about the pin is similar to that discussed above. In the embodiment of FIG. 7 in which each plate is constructed of a single molded piece, preferably of a plastic material, the wall of the groove limiting backward rotation is preferably constructed somewhat thicker than the steel plate of the embodiment of FIGS. 5 and 6 to achieve corresponding strength values. This, however, is a matter of selection of materials as well.

The armor structure 102 which is worn on the back necessarily lies at a distance from the bending line of the spinal column, that is to say, at a radial distance from the axis of rotation of the individual joints of the spinal column. Accordingly, it experiences an elongation when the spinal column bends forwardly and shortening when it bends rearwardly. This is accommodated by the longitudinal movement described in connection with the joint connections.

In FIG. 5, the armor 102 is illustrated in the straight position which corresponds to the upright position of the upper body. Plates 105 are illustrated here in the drawn apart, extended position. This representation has, however, been selected only to simplify the drawing. In fact, in the straight position of the armor shown in FIG. 5 the length of the armor would normally be reduced and the plates 105 would be slid together as far as possible so that they can move apart to the position shown in FIG. 6 when the back is bent forward. It is therefore advantageous to provide spring means to normally maintain the armor in the shortened position.

The sheathing 106 which surrounds the plate array in the manner of a hose advantageously serves this purpose. Thus, sheathing 106 comprises an elastomeric material which is elastically extensible in the longitudinal direction and is closed at opposite ends. Its length in an undeformed condition would thus be somewhat shorter than the length of the plate array and, consequently, holds the array longitudinally resiliently in its shortened position. If the back with the armor is then bent forward, the plate array becomes longer, acting against the spring force of the sheathing and are subsequently retracted again into the shortened condition when the back is straightened. The longitudinal spring effect of the sheathing can also be reinforced by the resiliently elastic effect of the molded foam body 110 in the longitudinal direction or can be exerted by the foam alone.

Figure 8:
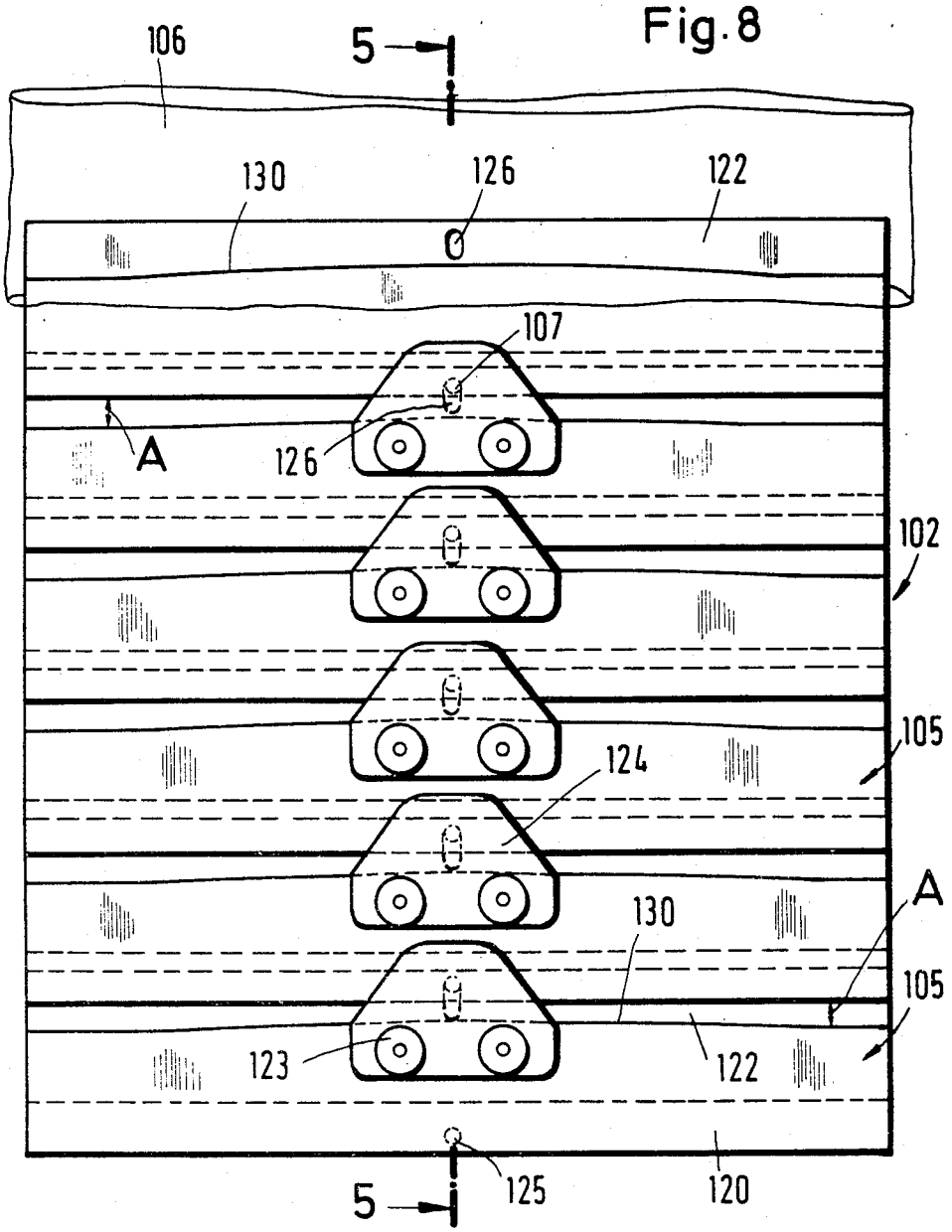
FIG. 8 is a rear view of the body armor of the type shown in FIGS. 5 and 6.

Armor 102 is shown from the rear in FIG. 8. Thus, in FIG. 8 the back of the wearer would be behind armor 102. A portion of sheathing 106 is shown at the top of FIG. 8 and 6 plates 105 are illustrated. The plates are provided along their central lines with steel plates 124 riveted to plates 105. The groove wall 122 and tongue 120 are identified in the lowermost plate.

The base 130 of the groove, identified in FIG. 6 on the uppermost plate, extends, as shown in FIG. 14, obliquely downwardly and outwardly toward the lateral ends of the plates. The distance A between the base 130 of the groove and the adjacent end of tongue 120 of the next plate 105 thus increases from the center to the sides.

When two adjacent plates are rotated about pivot ball 107 in the plane of the drawing, only a limited angle of rotation is permitted before tongue 120 abuts the base 130 of the groove. The angle of rotation of the plates with respect to each other is thus limited in this manner. The lateral bending of the back is thus also limited so that injuries to the spinal column caused by undesired excessive lateral bending are prevented. The oblique angle at which the base 130 of the groove falls away from the center of the plates to the side can be varied. The lateral inclinations of the spinal column to be permitted can thus be selected.

Figure 9:
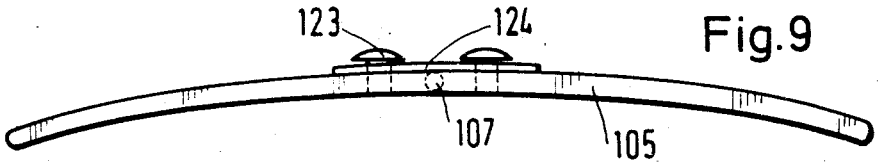
FIG. 9 is a top view of the plate structure of FIG. 8.

FIG. 9 is a top view of a plate 105 in which it is seen that the plates are adapted to the general lateral curvature of the back.

As will be recognized from the foregoing description, due to the difference in the angle of opening of the grooves between plates as well as the axial leeway in the hinge connection, tipping of the plates relative to each other to a certain angle is permitted, this being advantageously configured in such a way that it corresponds to the corresponding angle of bending of each part of the spinal column. Thus, the armor permits the required bending of the back within the normal limits but prevents overextension.

Because of the unsymmetrical design of the angle of motion which is permitted by the armor structure, the wearer can bend relatively far forward but is limited as to the backward movement beyond the straight position of the back. This mobility can be adapted to the individual requirements of the spinal column to be protected by selecting the angles discussed above.

With the characteristics described herein, a highly rigid structure of the plates is created in which the major portion of the plate can be constructed of a plastic, such as a high-impact plastic, with a separate steel plate used as an overextension stop as well as a portion of the pivot structure.

Because of the extent of elongation permitted between the plates, the plate array of the armor structure can be extended or shortened in the direction of overlap. As a result, the armor takes into account the radial clearance between the spinal column and the armor and, because of the lengthening and shortening associated with the plates of the armor, the individual plates remain relatively firmly associated with the body surface. Thus, firm seating and wear comfort are improved. It is important that the overall armor structure not slide with respect to the surface of the wearer's body.

With the elastic characteristics of the armor, the spring action allows the structure to maintain its shortest position when the back of the wearer is straight but, when the body is bent, the plating can extend against the relatively small elastic force of the spring material.

The casing surrounding the armor plates protects against clamping pieces of clothing or the like between plates which would impede free motion thereof.

Finally, the structure can easily be adapted to articles of clothing, being sewn into a jacket or the like or placed in a pocket formed in a jacket for the purpose. Thus, the armor structure is automatically placed correctly whenever the associated jacket is worn.

While certain advantageous embodiments have been chosen to illustrate the invention, it will be understood by those skilled in the art that various changes and modifications can be made therein without departing from the scope of the invention as defined in the appended claims.

What is claimed is:

1. A body armor structure for protecting the spinal column of a human body comprising a plurality of plates each having a width, in use, in a direction generally parallel with the adjacent surface of the body which is substantially greater than the lateral width of the spinal column; and means for interconnecting said plates in a scale-like, elongated array extending generally perpendicular to the width dimensions of said plates with adjacent ones of said plates being interconnected in an overlapping relationship such that at least the central portion of one edge of each plate lies outwardly of the adjacent edge of the next plate relative to said spinal column thereby forming a plurality of serial connections, each said means for interconnecting including hinge means pivotally connecting said central portion of said one edge to said adjacent edge of the next plate such that said plates are relatively pivotable about an axis which is generally perpendicular to the surfaces of said plates.

2. A structure according to claim 1 wherein said designated body portion is the spinal column and each of said plates has a width at least as great as the span of the flexor muscles on both sides of the spinal column to be protected.

3. A structure according to claim 2 wherein said plates are substantially identical to each other.

4. A structure according to claim 1 wherein said hinge means includes means at said one edge of each of said plates defining a groove and means at the opposite edge of each said plate defining a tongue received in the groove of the adjacent plate, said groove having opposite inwardly facing walls including an acute aperture angle greater than the angle between opposite walls of said tongue, said walls of said groove being spaced apart by a distance greater than the thickness of said tongue so that said plates are capable of limited relative movement about an axis parallel with said edges; and means for pivotally connecting said tongue in said groove.

5. A structure according to claim 4 wherein said aperture angle is nonsymmetrically tilted relative to the outer surfaces of said plate adjacent said groove.

6. A structure according to claim 4 wherein each said plate is made of two parts, each of said parts forming one of said inwardly facing walls of said groove.

7. A structure according to claim 6 wherein the one of said walls facing outwardly away from said protected body portion includes a recess, and wherein said means for pivotally connecting includes a rounded pivot member received in said recess.

8. A structure according to claim 7 wherein said pivot member comprises a pivot pin fixedly attached to said tongue and extending toward said protected body part, said pivot pin having a spherically shaped end.

9. A structure according to claim 7 wherein each said tongue includes a recess, and wherein said pivot member includes a generally spherical body trapped between a tongue and a groove wall in said recesses.

10. A structure according to claim 7 wherein said recess is elongated in the direction of elongation of said array so that said plates are capable of relative longitudinal shifting to permit elongation and shortening of said array.

11. A structure according to claim 10 and further comprising elastic means for maintaining said array of plates in its shortened arrangement.

12. A structure according to claim 1 wherein said hinge means includes clearance for permitting relative longitudinal shifting between said plates so that said array is capable of elongation and shortening.

13. A structure according to claim 12 and further comprising elastic means for maintaining said array of plates in its shortened arrangement.

14. A structure according to claim 12 and further comprising a casing having closed ends surrounding and enclosing said array of plates, said casing being elastic in the longitudinal direction of said array.

15. A structure according to claim 14 wherein said casing is dimensioned so that said plates in said array can move freely within said casing.

16. A structure according to claim 1 wherein said hinge means comprises a hole through said walls defining said groove, an elongated hole through said tongue, and a fastener passing through said holes.

17. A structure according to claim 1 and further comprising stop means protruding outwardly from the surfaces of said plates facing away from said protected body part for contacting an adjacent edge of an adjacent plate and limiting relative rotation of said plates on one direction.

18. A structure according to claim 1 and further comprising a resilient pad joined to said array of plates between said plates and said body portion to be protected.

19. A structure according to claim 18 and further comprising a garment capable of being worn and having a section generally covering said body portion to be protected; and means in said garment for receiving and retaining said array of plates and said resilient pad adjacent said body portion.

* * * * *